US006694616B1

(12) United States Patent
McKenna

(10) Patent No.: US 6,694,616 B1
(45) Date of Patent: Feb. 24, 2004

(54) METHOD OF FORMING T-CONNECTORS

(76) Inventor: Joseph McKenna, R.D. 5, Whangarei (NZ)

( * ) Notice: Subject to any disclaimer, the term of this patent is extended or adjusted under 35 U.S.C. 154(b) by 0 days.

(21) Appl. No.: 09/958,256

(22) PCT Filed: Apr. 13, 2000

(86) PCT No.: PCT/NZ00/00052

§ 371 (c)(1),
(2), (4) Date: Oct. 5, 2001

(87) PCT Pub. No.: WO00/61311

PCT Pub. Date: Oct. 19, 2000

(30) Foreign Application Priority Data

Apr. 13, 1999 (NZ) ..... 335164

(51) Int. Cl.[7] ..... B21D 51/16

(52) U.S. Cl. ..... 29/890.148; 29/890.141; 29/890.14; 72/368

(58) Field of Search ..... 29/890.148, 890.149, 29/890.14, 890.147, 890.141, 897, 897.3, 525.14, 525.13, 557, 890.08; 72/367.1, 368, 212, 213, 211; 138/177; 285/133.11

(56) References Cited

U.S. PATENT DOCUMENTS 4,148,426 A * 4/1979 Midzutani et al. ..... 228/146
4,491,004 A * 1/1985 Ivanoff ..... 72/168
4,706,488 A * 11/1987 Williamson ..... 72/96
5,253,502 A * 10/1993 Poletti ..... 72/213
6,216,511 B1 * 4/2001 Ohnishi et al. ..... 72/113

FOREIGN PATENT DOCUMENTS

| | | | |
|---|---|---|---|
| DE | 420014 A | * | 10/1925 |
| DE | 938665 | * | 2/1956 |
| DE | 4240906 A1 | * | 6/1994 |
| FR | 798402 | * | 5/1936 |
| GB | 693691 | * | 7/1953 |
| JP | 58-53329 | * | 3/1983 |

* cited by examiner

*Primary Examiner*—Charles T. Jordan
*Assistant Examiner*—T. Nguyen
(74) *Attorney, Agent, or Firm*—Dinsmore & Shohl LLP

(57) ABSTRACT

The invention provides a method of forming a T-shaped pipe (60) or tube connecting section, also referred to as a T-connector, T-junction or a T-section. The method comprises the step of cutting a form out of sheet metal, the form substantially comprising a rectangle having extensions on each side arranged in two pairs of opposing extensions (2) followed by the step of bending the edges of a first pair of opposing extensions **(6*a*, 6*b*) together to form a body having a central passage extending through the body in a first plane and a further passage (64)** extending from the exterior of the body to the central passage in a plane orthogonal to the first plane. The invention also provides apparatus arranged to form a T-connector.

7 Claims, 4 Drawing Sheets

METHOD OF FORMING T-CONNECTORS

FIELD OF INVENTION

The invention relates to a method of forming a T-shaped pipe or tube connecting section, also referred to as a T-connector, T-junction or T-section. The invention also relates to apparatus arranged to form a T-connector.

BACKGROUND TO INVENTION

T-connectors are particularly useful for connecting two pipes in situations where it is desirable to mix gas or liquid conveyed along one pipe with gas or liquid conveyed along another pipe. It could be desirable, for example, to join a minor pipe to a main pipe to enable gas or liquid conveyed along the minor pipe to be transferred to the main pipe.

Metal T-connectors are traditionally formed by forming a first length of pipe, cutting a hole in the side of the pipe intermediate its length, forming a second length of pipe, placing the second pipe adjacent the hole and welding the second pipe in place. This method is particularly cumbersome as it requires several different steps, each of which are difficult to automate.

The invention provides a new method and apparatus of forming T-connectors.

SUMMARY OF INVENTION

In broad terms in one form the invention comprises a method of forming a T-shaped pipe or tube connecting section comprising the steps of cutting a form out of sheet metal, the form substantially comprising a rectangle having extensions on each side arranged in two pairs of opposing extensions; and bending the edges of a first pair of opposing extensions together to form a body having a central passage extending through the body in a first plane and a further passage extending from the exterior of the body to the central passage in a plane orthogonal to the first plane.

In another form in broad terms the invention comprises a T-shaped pipe or tube connecting section produced by the above method.

In a further form in broad terms the invention comprises apparatus arranged to form a T-shaped pipe or tube connecting section comprising cutting apparatus arranged to cut a form out of sheet metal, the form substantially comprising a rectangle having extensions on each side arranged in two pairs of opposing extensions; and bending apparatus arranged to bend the edges of a first pair of opposing extensions together to form a body having a central passage extending through the body in a first plane and a further passage extending from the exterior of the body to the central passage in a plane orthogonal to the first plane.

BRIEF DESCRIPTION OF DRAWINGS

Preferred forms of the method and apparatus of the invention will now be described by way of example and without intending to be limiting, with reference to the accompanying drawings in which.

DETAILED DESCRIPTION OF PREFERRED FORMS

Figure 1:
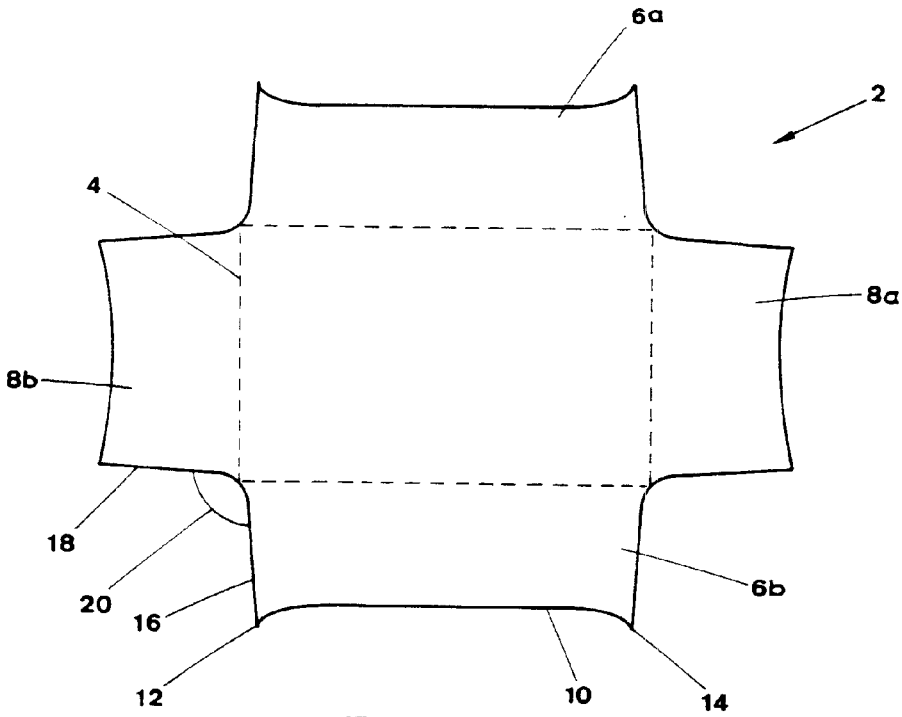
FIG. 1 illustrates the preferred form of the invention cut out of sheet metal.

Referring to FIG. 1, the T-shaped pipe or tube connecting section or T-connector of the invention is formed first by cutting a form out of sheet metal. The form 2 comprises a rectangle indicated at 4 having one pair of opposing extensions indicated at 6A and 6B respectively and a second pair of opposing extensions indicated at 8A and 8B respectively. It will be appreciated that the dimensions of rectangle 4 and hence the diameters of the resulting passages through the pipe connector could be varied. For example, the rectangle 4 could be formed as a square.

As indicated in FIG. 1, each of the extensions 6A, 6B, 8A and 8B is formed with non-linear outer edges. Edge 10, for example, curves inwardly between corners 12 and 14.

Preferably the angle between the sides of neighbouring extensions is greater than 90°. For example, side edge 16 of extension 6B intersects side edge 18 of extension 8A, at the angle shown at 20 which is preferably greater than 90°.

Figure 2:
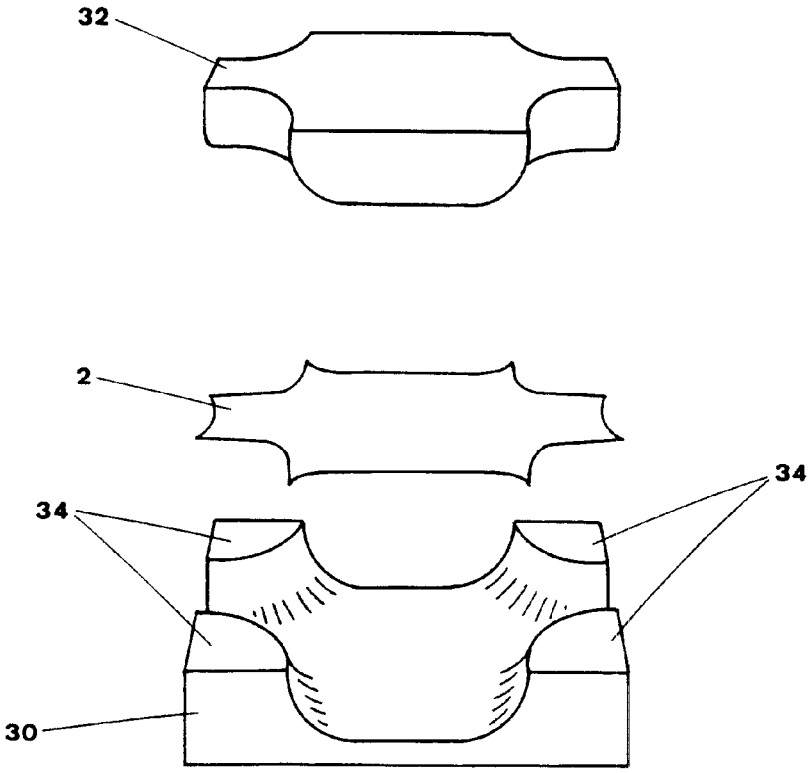
FIG. 2 shows the optional step of bending the form of FIG. 1 into two channels.

The edges of each extension are optionally bent to form two channels in the form 2 which will be described with reference to FIG. 2. The form 2 is pressed between complementary female die 30 and male die 32. The female die 30 is provided with projections 34 on which the form 2 is placed and temporarily supported. Male die 32 is pressed down onto form 2, forcing the extensions of the form 2 between the projections 34. The inner surface of each projection 34 is preferably shaped so as to bend the edges of each extension so that each side edge is elevated with respect to the centre of each extension.

Figure 3:
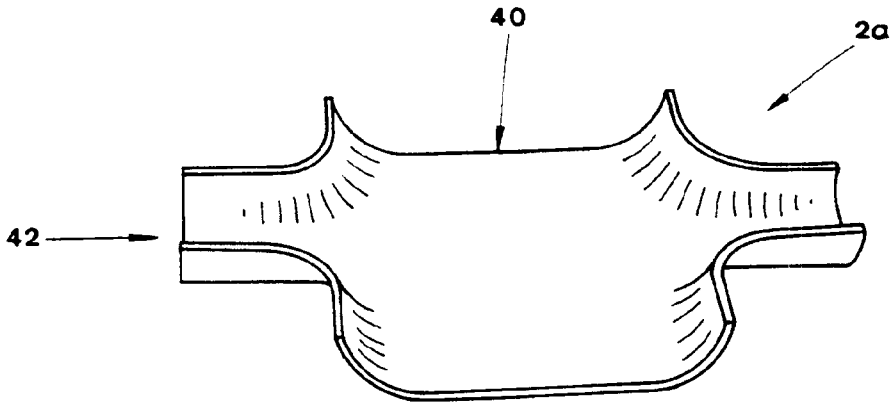
FIG. 3 shows the resulting form after the bending step of FIG. 2.

FIG. 3 shows the resulting preferred form 2A from bending with the dies 30 and 32. The outer edges of each extension are preferably bent to form two channels indicated at 40 and 42 respectively. The preferred channels 40 and 42 extend substantially orthogonally across the form 2A. Extensions 8A and 8B are bent together as will be described with reference to FIG. 4. The form 2A is placed on two spaced parallel rollers 50 and 52. The rollers are preferably spaced sufficiently to enable the form 2A to be positioned with the curved channel 40 extending between and parallel to the rollers 50 and 52. A cylindrical mandrel 54 is positioned along channel 40 on form 2A so that the mandrel 54 is positioned above or parallel to the rollers 50 and 52.

Shaft 56 is pressed down toward mandrel 54 by applying force to the shaft 56 in the direction indicated by arrow 58. The shaft 56 is arranged to engage cylindrical mandrel 54 and to press the mandrel 54 toward and between the rollers 50 and 52. Extension 8A and 8B are caused to move upwardly toward and around shaft 56. After bending, the form 2A is released by raising the shaft 56 above the form 2A and removing mandrel 54 from the form 2A along channel 40.

Figure 4:
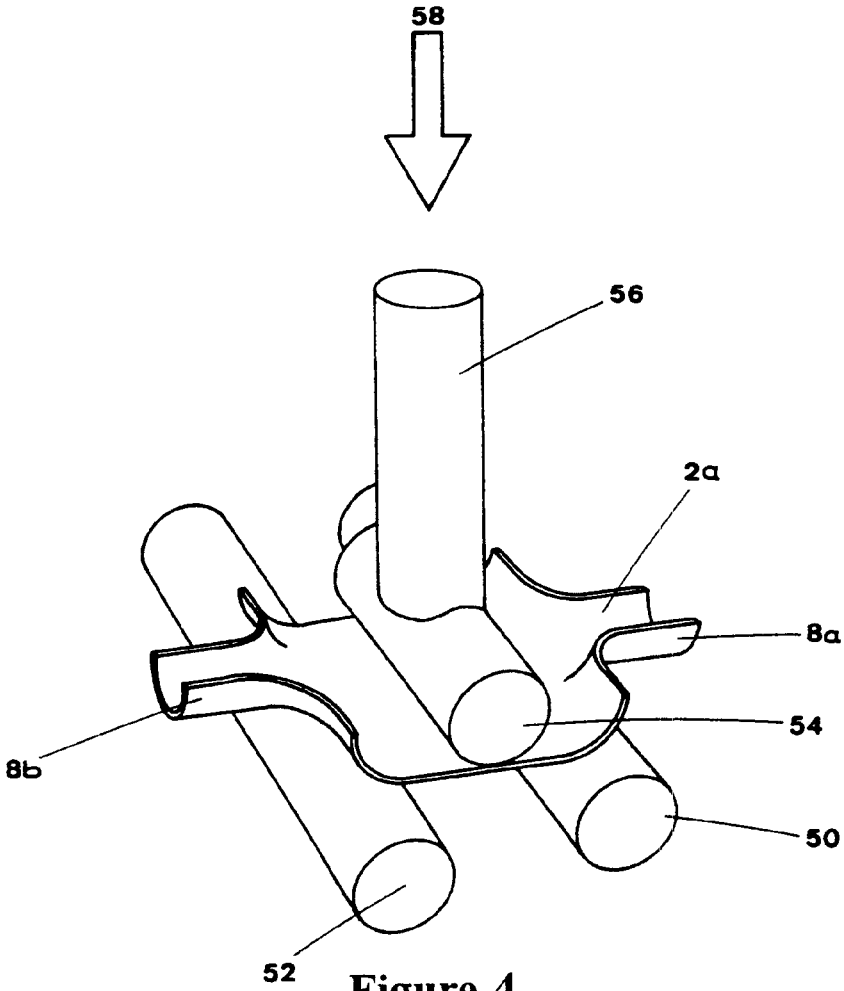
FIG. 4 illustrates the step of bending the form of FIG. 3.

It will be envisaged that the bending step shown in FIG. 4 could be applied either to the flat form 2 shown in FIG. 1 or to the bent form 2A shown in FIG. 3.

Figure 5:
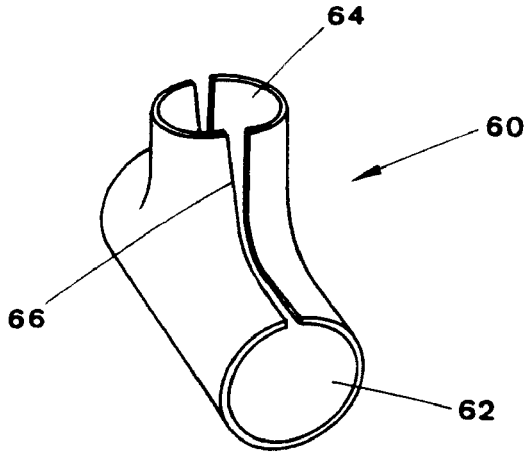
FIG. 5 shows the body resulting from the step of FIG. 4.

FIG. 5 illustrates the body 60 resulting from bending the form 2. The preferred body has a central passage indicated at 62 extending through the body 60 in a first plane and a further passage 64 extending from the exterior of the body 60 to the central passage 62 in a plane orthogonal to the first plane.

Figure 6:
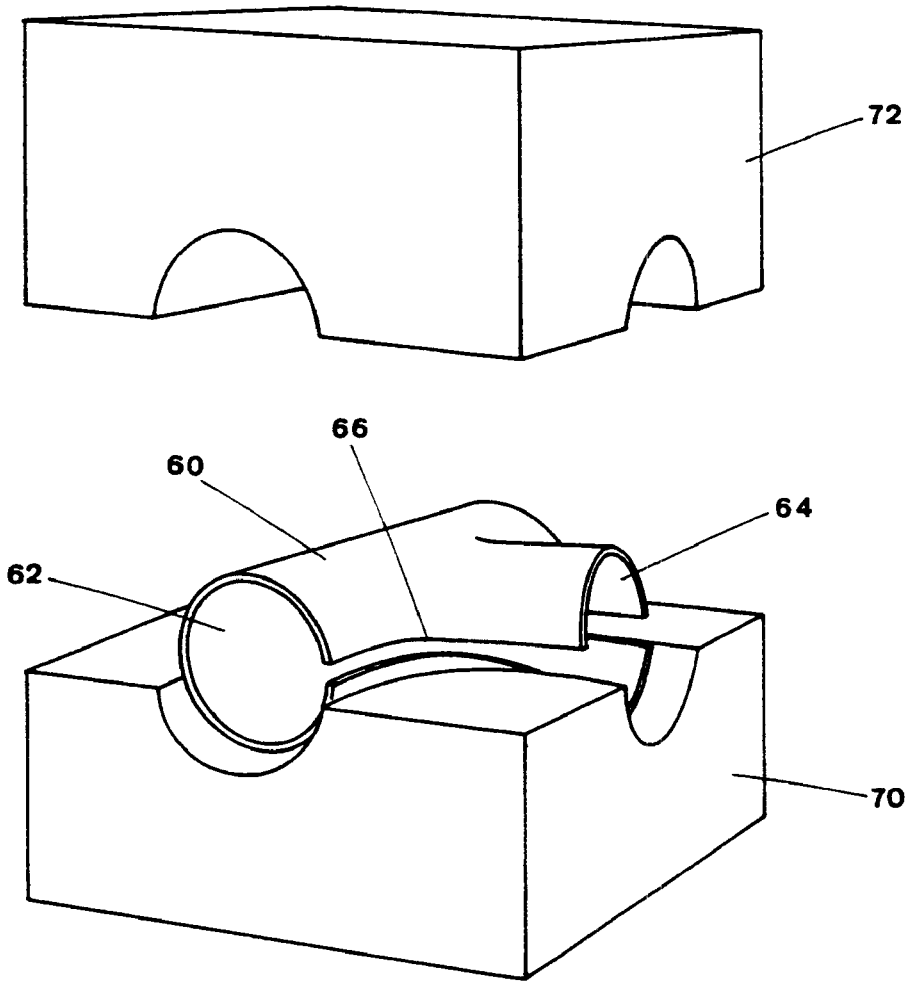
FIG. 6 shows the optional step of pressing the body of FIG. 5 between sizing dies.

In some circumstances, the bending step of FIG. 4 may result in a partially open seam such as that indicated at 66 between the edges of the extensions. In such circumstances as shown in FIG. 6, the body 60 could be pressed between complementary sizing dies 70 and 72. Each die is preferably formed with channels extending across each die shaped to receive the body 60. The channels have a suitable diameter to correctly size the channels 62 and 64 of the body 60 and to press the seams 66 of the body together.

The body 60 may then be welded along seams 66 to seal and close the seams in circumstances where it is necessary to form a water or air tight pipe connector.

Figure 7:
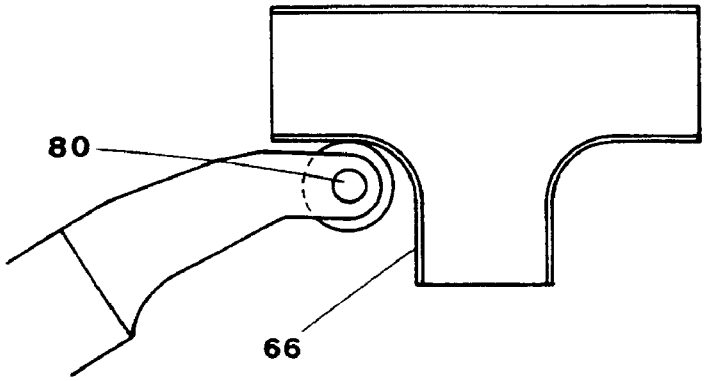
FIGS. 7 and 8 show the optional steps of smoothing the seams of the body resulting from the steps of FIGS. 4 and/or 6.
Figure 8:
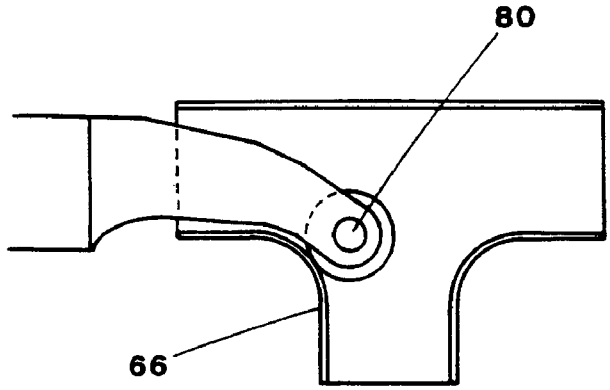

As shown in FIG. 7, the seams 66 may optionally have a smoothing roller 80 applied to the exterior of the seam 66 as shown in FIG. 7 and the interior of the seam 66 as shown in FIG. 8.

It is envisaged that the pipe connector could be formed from sheet metal. Alternatively, the initial form could be cut from a suitable rigid plastic sheet which is heated and then shaped in the manner described with reference to the above figures. The preferred pipe connector is particularly suitable for use in connecting pipes or tubes arranged to convey liquid or gas. It is also envisaged that the connector could be used to connect solid cylinders and pipes not intended to convey liquid or gas, for example in the building and construction industry where it is necessary to secure metal rods at right angles to each other.

The invention provides a method and apparatus of forming a T-connector from a single sheet of material. The method is simple and more suited to automation than the traditional method of forming a T-connector. By altering the dimensions of the initial form cut from the sheet the diameter and other dimensions of the resulting T-connector can be altered. By altering the thickness of the sheet it is possible to alter the wall thickness of the T-connector.

The foregoing describes the invention including preferred forms thereof. Alterations and modifications as will be obvious to those skilled in the art are intended to be incorporated within the scope hereof as defined by the accompanying claims.

What is claimed is:

1. A method of forming a T-shaped pipe or tube connecting section of unitary construction comprising the steps of:

cutting a form out of sheet metal, the form substantially comprising a rectangle having an extension extending from each side;

bending the form to form two channels extending substantially orthogonally across the form; and rolling the form about a cylindrical mandrel positioned along one of the channels to bend the extensions on opposite sides of the form towards each other to form a body having a central passage extending through the body and a further passage extending from the central passage to the exterior of the body.

2. A method of forming a pipe or tube connecting section as claimed in claim 1, comprising the additional step of pressing the form between complementary male and female dies to form the two channels.

3. A method of forming a pipe or tube connecting section as claimed in claim 1 wherein the extensions are brought towards each other by placing the form on two spaced parallel rollers, placing the mandrel along one of the channels so that the mandrel is positioned above the rollers, and pressing the mandrel toward and between the rollers.

4. A method of forming a pipe or tube connecting section as claimed in claim 1 further comprising the step of pressing the seams of the body together between complementary sizing dies.

5. A method of forming a pipe or tube connecting section as claimed in claim 1 further comprising the step of welding the seams of the body together.

6. A method of forming a pipe or tube connecting section as claimed in claim 5 further comprising the step of applying one or more smoothing rollers to the interior and/or exterior of the welded seams.

7. A T-shaped pipe or tube connecting section produced by the method of claim 1.

* * * * *